United States Patent [19]

Swanson

[11] 4,086,049

[45] Apr. 25, 1978

[54] IGNITOR FOR STARTING FIRES

[76] Inventor: Bernard August Swanson, 11805 SE. 54th. Pl., Bellevue, Wash. 98006

[21] Appl. No.: 752,558

[22] Filed: Dec. 20, 1976

Related U.S. Application Data

[63] Continuation-in-part of Ser. No. 651,606, Jan. 22, 1976, abandoned.

[51] Int. Cl.[2] ..... F23Q 1/06

[52] U.S. Cl. ..... 431/271; 126/59.5; 431/269

[58] Field of Search ..... 431/269, 171, 256; 126/59.5; 110/1 F; 60/634, 635

[56] References Cited

U.S. PATENT DOCUMENTS 2,006,171 6/1935 Kalhaus et al. ..... 431/269 X 3,635,649 1/1972 Kafka ..... 431/269

*Primary Examiner*—Edward G. Favors

*Attorney, Agent, or Firm*—Nicolaas DeVogel

[57] ABSTRACT

A device for igniting orchard heaters or the like consisting of a housing carrying a repeatable hammer with firing pin for firing an explosive primer to light the fuel/gas of the heater. The hammer and firing pin is contained within a cylinder which is driven by an associated fluid (fuel/gas) pressure source and the displacement of the cylinder causes compression of the spring for activating the hammer. A plurality of primers is contained in a disc which rotates and aligns a new primer before the firing pin after each firing is completed. The rotation of the disc is caused by the displacement of the cylinder.

6 Claims, 4 Drawing Figures

IGNITOR FOR STARTING FIRES

CROSS-REFERENCE TO RELATED APPLICATIONS

This application is a continuation-in-part of Application, Ser. No. 651,606 filed Jan. 22, 1976 and now abandoned.

BACKGROUND OF THE INVENTION a. Field of the Invention

This invention relates to automatic ignition devices and, more particularly, to an automatic repeatable ignitor for starting fires in orchard heaters or the like.

b. Prior Art Description

In the patent literature of ignitors for orchard heaters there appeared to be no devices which could be remotely compared with the existing disclosed device. The art of record showed several patents of a somewhat pertinent nature but which do not operate the same nor are used for the same purpose. In the search were found U.S. Pat. Nos. 2,485,394, 2,208,496, 2,470,117 and 2,207,635. The last two patents being in class 89-1, and considered to be good references to the herein disclosed invention.

Since the patent search indicated that the present invention is novel, a study made in the practical art, which stimulated the creation of the present concept, showed the development of electrical igniting devices for lighting the fires in the orchard heaters. However, electrical lighters require electrical conduits or cables which have to be buried in the ground between the fruit trees. The fruit farmers object to the underground wiring since it is customary that after the harvest is completed, all the soil is cleared from the undergrowth and tilled for absorbance of oxygen, etc. The farm equipment would dig and hit the lines and the resulting shorts, shocks or later fires from damages wires, etc. are too objectionable. In addition, the electrical devices utilize electrodes which act unreliably during the frost period when the firing of the heaters takes place. Furthermore, the present invention does away with the individual fuel containers which would not be resolved by the electrical concept.

Accordingly, the electrical systems that were invented and experimented with have been discontinued since they were unsuccessful and the farmers are returning to the old system of employing a few youngsters for lighting manually all the hundreds of heaters at the first frost forecasts that are received for their particular location.

SUMMARY OF THE INVENTION

The present device is made to be mounted in each orchard heater above the fuel nozzle. An associated power source such as a pneumatic or hydraulic compressor is connected via suitable conduits to each heater and fuel/gas is piped to each heater. The pressure is provided (in lbs.) in the range of 175–200 for fuel/oil and approximately 4 – 6 for gases to activate the hereinafter disclosed automatic ignitor for starting fires and for providing fuel to the heaters.

It will be realized that the invention is very useful and has far-reaching advantages for the fruit grower in particular. For instance, he does not need to employ the several helpers who, during the frost periods, stay for 24 hours around the place for several months. Also when the Forecast Bureau informs the farmers or growers that a frost is expected, the helpers have to run among the trees and light each heater. Normally, the small grower utilizes between 150 to 500 heaters, and it takes some time to circle the area and keep lighting the fires while moving towards the center of the location. Still each grower losses some trees because the frost beats the speed of the helpers and many branches are frozen when the onset of the frost is too rapid.

The presently disclosed device would start all the heaters simultaneously upon the mere opening of a valve or valves at certain locations — farmhouse, etc. The fuel fluid pressure provided, be it either hydraulic (oil) or pneumatic (gas), displaces a spring biased piston-cylinder which accordingly places a hammer, striking pin and firing pin in alignment against a cap of a primer. Continuous pressure will activate the hammer against the striking pin which will carry the impact to the firing pin for igniting the cap and the primer, resulting in a large hot flame which will light the heater immediately. When the valve is shut the pressure drops. After the lighting or fire is started, the device automatically, upon retraction of the piston-cylinder, is ready for the next firing.

Accordingly, it is an object of the present invention to provide for an igniter for starting fires by fuel-fluid pressure means at a remote location through mechanical means for activating chemical ignition means to create a flame.

Another object of the present invention is to provide for an ingiter for starting fires, which is simple in design, inexpensive to manufacture, reliable during the cold seasons and ambient weather influences, easy and effective and economic to the farm-fruit growers.

An important object is the built-in time delay of firing which provides for enough fuel vaporation prior to ignition so that a "sure" starting of the heater is obtained.

These and other objects, advantages and features of the invention will appear more fully from the following detailed description when the same is read in connection with the accompanying drawings. It is to be expressly understood, however, that the drawings are not intended as a definition of the invention, but are for the purpose of illustration only.

OPERATION OF THE INVENTION

The present invention is illustrated in one preferred embodiment only and in the herein following description, like reference numbers denote corresponding parts throughout the several views.

Figure 1:
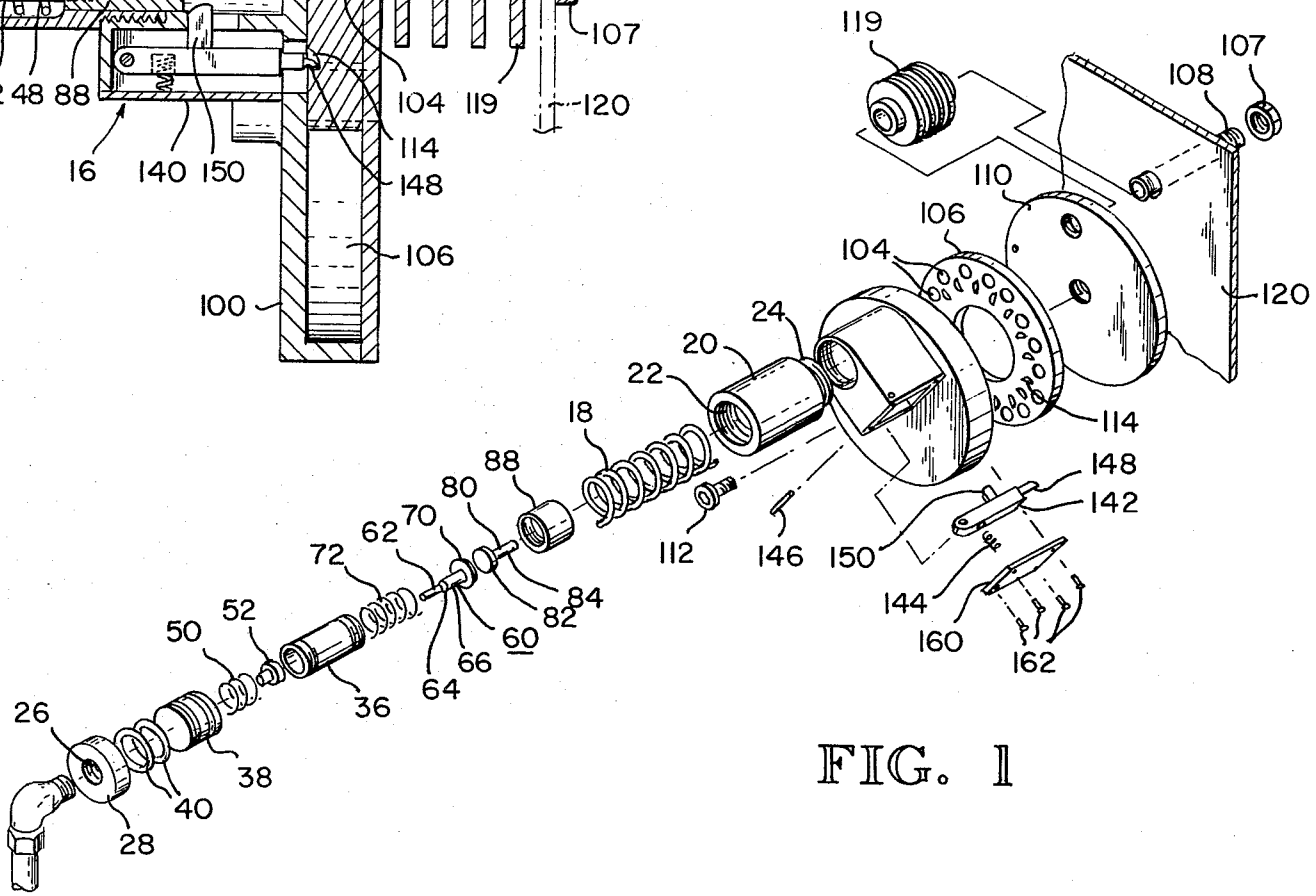
FIG. 1 is an exploded and isometric view of the igniter, showing every part in its proper relationship prior to assembling.
Figure 2:
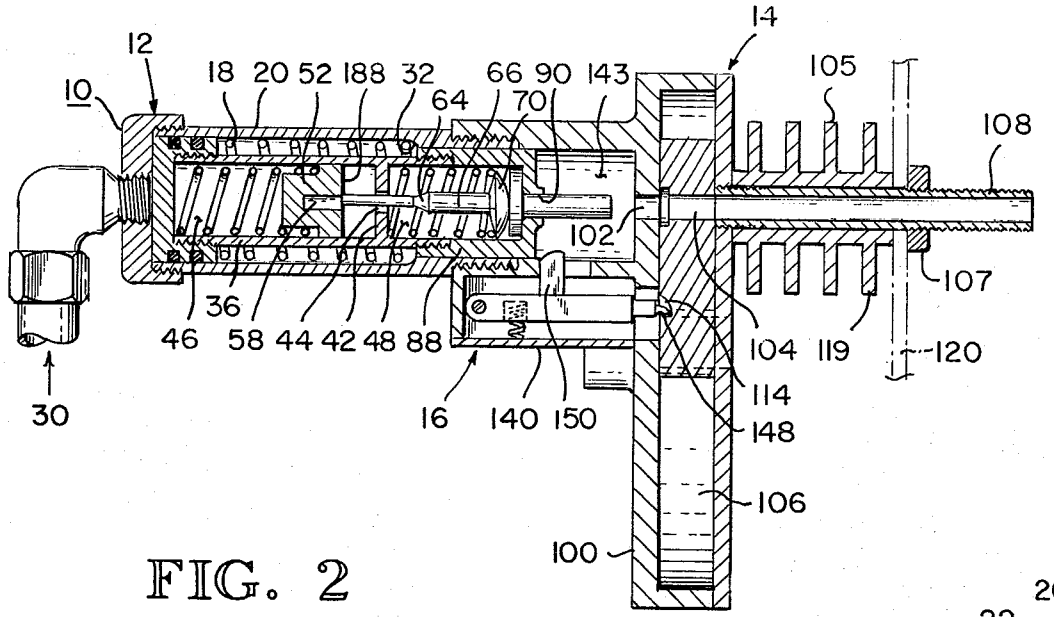
FIG. 2 is a vertical sectional view of the assembled device.

Referring now to FIGS. 1 and 2, there is basically illustrated an igniter 10 comprising of three main assemblies: a firing activating assembly 12, a primer magazine assembly 14 mounted next to the firing activating assembly 12 and a primer cap aligning assembly 16 which is mounted next to the firing activating assembly 12 and the primer magazine assembly 14.

The firing activating assembly 12 comprises a housing 20 having threaded portions 22 and 24 at each end and a threaded fluid pressure input opening 26 in its closure cap 28 for the connection of an associated pneumatic or hydraulic input 30. The housing 20 has internally a stepped bore which step is pronounced as an internal shoulder portion 32. A piston-cylinder 36 is positioned in said housing 20 and said piston-cylinder has a threaded-on pistonhead 38 which carries sealing rings 40. A cylinder-piston spring 18 is positioned between said pistonhead 38 and said shoulder portion 32.

Inside of the cylinder-piston 36 is an integrally mounted wall 42 having an opening in its center 44 and which wall 42 divides the cylinder-piston into a first chamber 46 and a second chamber 48.

In the first chamber 46 is a hammer spring 50 and hammer 52. The hammer spring 50 is positioned between the internal surface of the pistonhead 38 and the hammer 52 thereby forcing the hammer 52 towards the wall 42. The hammer 52 is further provided with a deadending opening 58 at the wall 42 side, which opening is in alignment with the wall center opening 44. In the second chamber 48 is a striker pin 60 having a first portion 62 with a diameter that fits easily through holes or openings 44 and 58, halfway of the striker pin 60 is a beveled portion 64 and thereafter a straight portion 66 somewhat larger in diameter than said first portion 62 ending in a slanted or non-symetric shaped mushroom-head 70. A striker spring 72 pushes the head 70 away from the wall 42 since the spring 72 is positioned between the head 70 and the wall 42 but, also, and very important, is the fact that, because the mushroom head is slanted the striker pin will not align with the hole 58.

Accordingly, the mushroom head 70 will always abut against the firing pin 80 which has a flat head portion 82 and a firing pin portion 84. As illustrated, the piston-cylinder 36 has a threaded portion 24 on which is threaded a cylinder closure housing 88 which is provided with an aligning aperture 90 for permitting the firing pin portion 84 to extend out of the cylinder closure housing 88.

Figure 3:
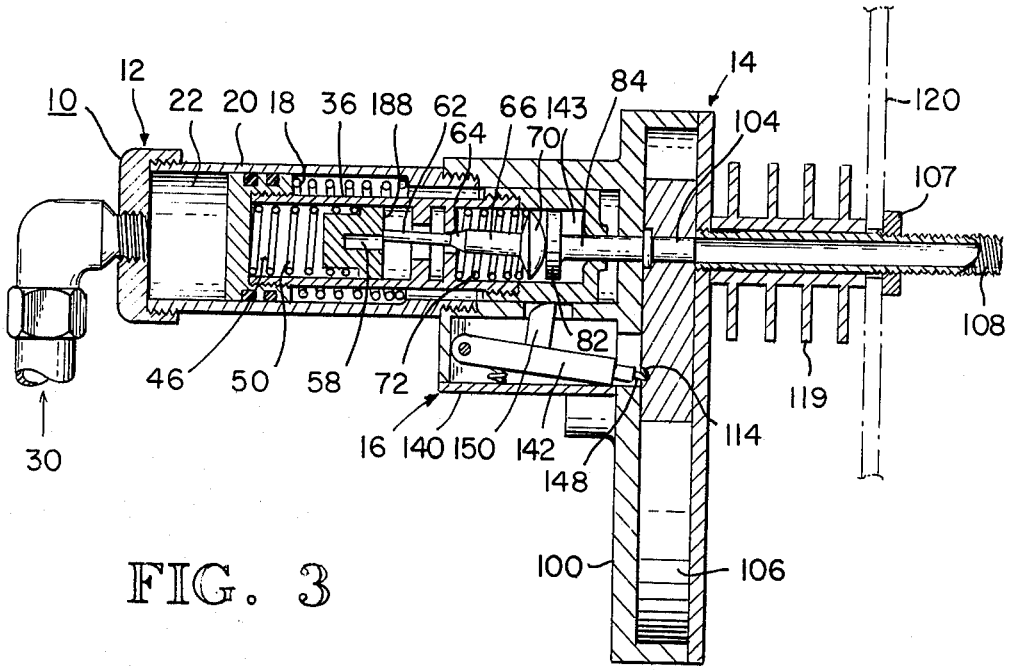
FIG. 3 is the same view as shown in FIG. 2, with the exception that the device has been activated and is moved into the stage just prior to the firing moment or primer ignition event.
Figure 4:
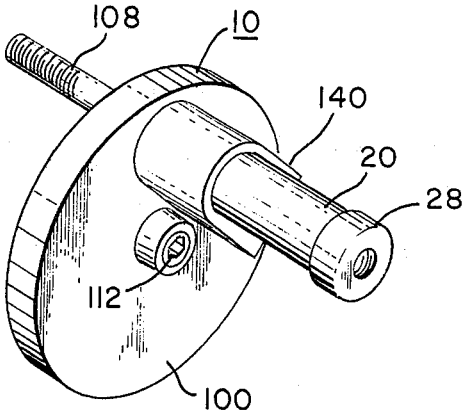
FIG. 4 is an isometric view of the device when completely assembled for mounting into a heater or other object to be ignited.

The primer magazine assembly 14 comprises a housing 100 which has a cap opening 102 that aligns with a plurality of caps 104 which are located in a one-way rotatable disc 106 that is rotably positioned in said housing 100. Then a flame exhaust nozzle 108 is mounted in direct alignment with the cap hole 102 and the cap 104 at the axis on which the striker pin portion abuts the cap 104, as illustrated clearly in FIG. 3. The disc 106 can be filled with caps 104 when the cover plate 110 is removed by unscrewing the fastener 112. As shown in FIGS. 1, 2 and 3, the device or igniter 10 is positioned or fastened via heat insulator 119 against the heater wall 120, shown in dot-dashed fashion. Besides the plurality of caps 104 that are positioned in the disc 106, there are also an identical number of indent means 114 or any other means for enabling the exact number of degrees of rotation of the disc 106 so that always a cap is in direct alignment with the striker pin portion 84.

The positioning of the cap 104 with the striker pin end portion 84 is accomplished by the primer cap aligning assembly 16. The assembly is housed in a housing 140 which may or may not be an integral part of the housing 100. In the housing 140 is located a spring-loaded dog ratchet 142 having a spring 144 and pivoted over pivot 146. Furthermore, the dog ratchet 142 has a cam portion 150 that extends freely into the firing pin chamber 143 being part of the housing 140. The dog ratchet 142 comprises further a spring or a bias means 148 or the like which extends into the magazine housing 100 and leans in contact with the indent means 114 in the disc 106.

The housing 140 has a closing lid 160 which is secured by the fasteners 162. The complete operation of the present igniter 10 takes place in a few seconds and all that is required is the opening of a remotely located valve in order to allow fuel-fluid pressure to enter the firing activating assembly 12. Simultaneously the fuel-fluid also evaporates in the orchard heater, then after a few seconds the flame is produced from the exhaust nozzle 108 and the heater fire is started. Assuming thus that one opens the pneumatic or hydraulic activating pressure valve, the fluid pressure entering through input 30 will move the piston head 38 and its thereon connected piston-cylinder 36 from the inactive position shown in FIG. 2 to the firing (or just before firing) position as illustrated in FIG. 3. When that happens, the pistonhead 38 will compress the spring 18 and the cylinder-piston moves towards the primer magazine assembly 14. The firing pin end portion 84 will abut with the cap 104 and the continued fluid pressure will move the hammer 52 by the pushing of the first portion of the striker pin 60, which because of its slanted mushroom head 70, tilts the striker pin 60 slightly so that the first portion 62 leans against the hammer surface 188 just next to the dead-ending opening 58. Thus the hammer spring 60 and also the spring 72 become compressed. Upon continued pressure one can realize that the beveled portion 64 works as a cam surface against the opening edge of opening 44 and thus realigns the striker pin first portion 62 so that it moves into the opening 58 which, of course, gives a sudden expansion to the hammer spring 50 and bangs the hammer dead-ending opening with its dead-end against the end of the striker pin first portion 62. This blow or bang is carried through via the mushroom head 70, the firing pin head 82 and its firing pin end portion 84 against the cap 104 which then ignites and causes the primer to explode into a fierce, hot pointed flame which will immediately start the fire in the fuel-vapored heater. In the meantime, while the piston-cylinder 36 and its thereon threaded cylinder closure housing 88 was moving towards the magazine assembly 14, the cam 150 was depressed which in turn caused the spring or bias means 148 to move the disc 106 by its contact into the indent means 114, so that a new cap was positioned in front of the firing pin 80.

When the orchard heaters are turned off by the remote valve, the fluid pressure is relieved and the piston-cylinder 36 moves slowly to the inactive position as shown in FIG. 1 by the spring pressure of spring 18, the hammer will move back and the springs 50 and 72 will relax but not completely, since spring 72 will (by its pressure on the mushroom slanted head 70) push the first portion 62 that has come out of the dead-ending opening 58 slightly out of alignment of the horizontal axis of the device 10 so that it leans again against the surface 188 of the hammer 52 next to the dead-ending opening 58. The exhaust nozzle has a plurality of cooling fins 105 working as temperature spacers between the heater and magazine assemby and mounted by nut 107.

In order to completely describe the present invention in conjunction with the whole system, it should be understood that in general the farmer's house or by-buildings contain a fluid tank, either gas or oil fuel, which via a compressor and valve is piped towards each orchard heater in the orchard. The pipe connects in each heater to a burning nozzle which will spray the fuel-liquid into the burning area of the heater. By means of a "T" section in the pipe, just before the burning nozzle, is a pipe connection provided which hooks onto entrance 30. Thus, when the valve is turned open, the fuel sprays out of the burning valve and evaporates. In the meantime, the pressure will move the piston-cylinder, providing enough delay to cause the ignition flame to appear at the correct moment when enough fuel/gas is present to start the orchard heater. The igniter is normally located above the burning nozzle of the orchard heater.

While the preferred embodiment of the present invention has been illustrated and explained herein, it will be understood that various changes may be made in the combination, construction or arrangement of the various parts by those who are skilled in the art; however, without departing from the scope of this invention as it has been claimed hereinafter.

Now, therefor I claim:

1. An igniter for starting fires comprising in combination:

a. a firing activating assembly;

b. a primer magazine assembly mounted next to said firing activating assembly;

c. a primer cap aligning assembly mounted next to said firing activating assembly and said primer magazine assembly;

d. said firing activating assembly comprising a housing containing a piston-cylinder adapted for displacement from an inactive position to a firing position through input of an associated fluid pressure into said housing;

e. said piston-cylinder containing an integrally mounted wall, with an opening in its center, dividing said piston-cylinder into a first and a second chamber;

f. said first chamber successively containing a slidably arranged hammer spring and a hammer means with a dead-ended opening facing toward said wall opening;

g. said second chamber provided with an aligning aperture and successively containing: a striker pin with a first portion having a diameter smaller than said wall opening and said hammer opening, a beveled expanding portion, a larger diameter second portion of a diameter smaller than said wall opening and a slanted mushroom-shaped head portion, respectively; a striker spring positioned between said wall and said mushroom head and a firing pin having a head portion abutting said mushroom head and a firing pin portion extending out of said piston-cylinder through said aligning aperture;

h. said primer magazine having a cap opening in direct alignment with said aligning aperture and adapted to receive said firing pin portion, said primer magazine containing a one-way rotatable disc carrying a plurality of associated primer caps and a flame exhaust nozzle in alignment with and opposite of said cap opening, and said rotatable disc having indent means near each of said primer caps; and i. said primer aligning assembly containing a spring-loaded dog ratchet having a cam extending into said housing and a bias means extending in said magazine assembly in contact with said indent means, whereby upon displacement of said piston-cylinder into said firing position said cam is depressed and said dog ratchet moves said bias means for rotating said disc by said indent means so that an associated cap becomes aligned between said opening and said exhaust nozzle.

2. An igniter for starting fires as claimed in claim 1, wherein said housing containing said piston-cylinder comprises an internal bore having an internally projecting shoulder means and wherein said piston-cylinder comprises a piston-portion connected to a cylinder-portion disposed in said bore for displacement and wherein a piston spring is located about said cylinder portion and between said piston-portion and said shoulder for providing a force for moving said piston-cylinder towards said inactive position.

3. An igniter for starting fires as claimed in claim 2, wherein said housing in said firing activating assembly includes a housing closure means having input means for said associated fluid pressure source and wherein said closure means faces toward said piston portion.

4. An igniter for starting fires as claimed in claim 3, wherein said dog ratchet bias means in said primer aligning assembly comprises a leaf spring fitting with said indent means for rotating said disc in a one-way direction so that an associated cap carried by said disc becomes aligned with said firing pin.

5. An igniter for starting fires as claimed in claim 4, wherein said piston-portion is provided with sealing-piston rings for providing a close fit with said bore in said housing.

6. An igniter for starting fires as claimed in claim 5, wherein said flame exhaust means has a plurality of cooling fins for spacing said primer magazine assembly apart from an associated heater hot wall or the like to which said igniter is mounted.

* * * * *